United States Patent [19]

Barnes et al.

[11] 4,193,574

[45] Mar. 18, 1980

[54] WELL SHUT OFF DEVICE

[76] Inventors: Johney H. Barnes; Lucynda D. Barnes, both of 1463 Hartnell, Space 25, Redding, Calif. 96001

[21] Appl. No.: 955,170

[22] Filed: Oct. 27, 1978

[51] Int. Cl.[2] ..... E21B 33/06; F16K 3/00

[52] U.S. Cl. ..... 251/1 A; 166/82; 251/212; 277/127

[58] Field of Search ..... 251/1 R, 1 A, 212; 166/82, 84, 86, 88; 277/9, 31, 126, 127, 129; 15/210 B, 256.6

[56] References Cited

U.S. PATENT DOCUMENTS

| | | | |
|---|---|---|---|
| 1,788,763 | 1/1931 | Gant et al. | 277/126 X |
| 1,877,268 | 9/1932 | Cole | 277/9 |
| 2,026,036 | 12/1935 | Head | 15/210 B X |
| 2,142,179 | 1/1939 | Cole | 277/9 |
| 2,231,613 | 2/1941 | Burke | 277/129 |
| 2,718,021 | 9/1955 | Baebel | 15/210 B X |

*Primary Examiner*—Martin P. Schwadron
*Assistant Examiner*—Richard Gerard
*Attorney, Agent, or Firm*—Clarence A. O'Brien; Harvey B. Jacobson

[57] ABSTRACT

A hollow closed housing is provided to be interposed in a well casing string and the housing includes vertically spaced upper and lower walls interconnected by first and second pairs of opposite side walls. The upper and lower walls have registered passages formed therethrough relative to which axially spaced lower and upper ends of upper and lower well casing sections may be sealingly secured and a pair of superposed control plates are slidingly mounted within the housing between the upper and lower walls thereof for inverse shifting toward and away from one pair of opposite side walls of the housing between the second pair of housing side walls. The plates have oppositely facing elongated keyhole-shaped opening formed therethrough including large diameter partial cylindrical first ends and small diameter partial cylindrical second ends opening into the first ends remote from the closed ends thereof. The plates are shiftable relative to each other and the housing between first positions with the smaller second ends of the keyhole openings registered in a complementary manner to form a small diameter bore registered and coaxial with the aforementioned passages, second positions with the larger first ends of the keyhole openings registered in a complementary manner to form a large diameter bore registered and coaxial with the passages and third positions with the keyhole openings completely out of registry with the passages.

2 Claims, 4 Drawing Figures

WELL SHUT OFF DEVICE

BACKGROUND OF THE INVENTION

1. Field of the Invention

During the process of drilling gas and oil wells circumstances sometimes occur which result in fire at the well head and in these instances it is necessary to close off the effluent from the well in order to extinguish the fire. Although various forms of devices have been previously known for the purpose of closing off a well casing string against the discharge of gas or oil from the upper end thereof, many of these previously known devices have not included structure effectively conducive to simple operation, quick operation and the ability to conform to the size of a particular drill stem in use.

2. Description of the Prior Art

Examples of previously known forms of well shutoff devices are disclosed in U.S. Pat. Nos. 799,967, 998,400, 1,560,859, 1,592,249, 1,692,302, 1,788,763, 1,909,304, 2,512,744, 3,102,709 and 3,554,480.

BRIEF DESCRIPTION OF THE INVENTION

The well shutoff device of the instant invention is constructed in a manner whereby the casing string may be completely closed if the drill stem is blown out of the casing, or whereby the casing string may be closed off about the drill stem if the stem has not been blown from the casing. The shutoff device includes a pair of superposed valve plates having oppositely facing vertically registrable keyhole openings formed therethrough and the plates may be shifted relative to each other in order to register the large diameter portions of the openings with each other, the small diameter portions of the openings with each other, or to position with the keyhole openings completely out of registry with each other and the registered casing passages formed through the upper and lower walls of the housing of the shutoff device.

In addition, the relatively shiftable valve plates include replaceable inserts whereby the effective small diameter portions of the keyhole openings may be varied in size and the removable inserts, themselves, include resilient portions which define the small diameter portions of the keyhole openings, thereby enabling the shutoff device to be more tightly closed relative to a drill stem projecting upwardly through the associated casing.

The main object of this invention is to provide a well shutoff device which may be closed in order to terminate the escape of effluent from a gas or oil well.

Another object of this invention is to provide a well shutoff device which may be operated to close the associated well casing either with or without a drill string projecting through the casing.

Yet another object of this invention is to provide a well shutoff device which may be conveniently remotely actuated.

Still another important object of this invention is to provide a well shutoff device constructed in a manner whereby it may be readily adopted for use in conjunction with wells having different size drill stems extending downwardly therethrough.

A final object of this invention to be specifically enumerated herein is to provide a well shutoff device in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
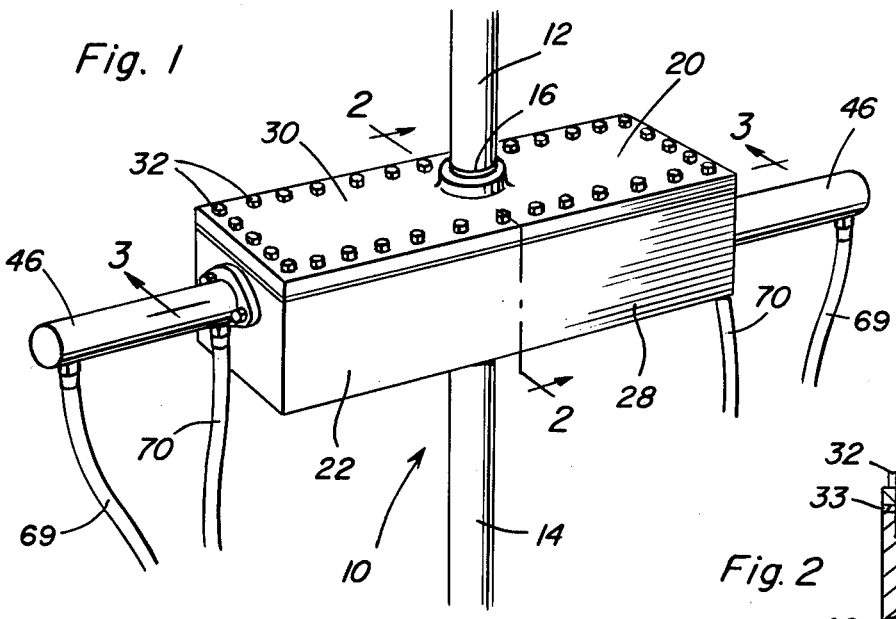
FIG. 1 is a fragmentary perspective view of a typical well casing with the well shutoff device of the instant invention interposed between and operatively associated with upper and lower well casing sections.

Referring now more specifically to the drawings, the numeral 10 generally designates a well casing assembly including upper and lower vertically spaced casing sections 12 and 14 whose lower and upper ends 16 and 18, respectively, are externally threaded.

The well shutoff device is referred to in general by the reference numeral 20 and includes a horizontally elongated housing 22 having a bottom wall 24 extending between first and second pairs of opposite side walls 26 and 28, the opposite side walls 26 comprising end walls of the housing 22 and the opposite side walls 28 comprising longitudinal side walls of the housing 22.

The upper side of the housing 22 is closed by means of a removable top wall 30 secured in overlying relation relative to the upper marginal edges of the walls 26 and 28 by means of a plurality of peripherally spaced fasteners 32 and a suitable gasket 33 is interposed between opposing sealing surfaces of the walls 26 and 28 and the upper wall 30.

The lower and upper walls 24 and 30 include passages 34 and 36 formed therethrough in registry with each other and the remote ends of the passages 34 and 36 include threaded counterbores 38 and 40 in which the externally threaded ends of the sections 14 and 12 are threadedly engaged.

A pair of upper and lower slide plates 42 and 44 are disposed within the housing 22 between the longitudinal side walls 28 thereof and the plates 42 and 44 are shorter than the longitudinal extent of the interior of the housing 22 and are, therefore, longitudinally shiftable within the interior of the housing 22.

The end walls 26 of the housing 22 include double acting hydraulic cylinders 46 mounted thereon and each cylinder 46 includes a piston rod portion 48 sealingly and slidingly received through the corresponding end wall 26 as at 50 and anchored relative to one of the plates 42, 44 as at 52.

It is to be noted that the hydraulic cylinders 46 will be operated inversely so as to inversely shift the plates 42 and 44 within the housing 22 through the end walls 26 thereof.

The plates 42 and 44 include oppositely facing vertically registrable keyhole-shaped openings 54 formed therethrough. Each keyhole-shaped opening 54 includes a large diameter partial cylindrical end 56 and a smaller transverse dimensioned end 58, see FIG. 4. Each of the smaller transverse dimensioned ends 58 of the openings 54 has an insert 60 removably and exchangeably received therein and each insert 60 includes a smaller inset 62 of slightly deformable and resilient material defining a small diameter partial cylindrical end 66 of the corresponding keyhole opening 54, the small diameter end 66 defining a restrictive throat area 68 which opens into the large diameter partial cylindrical end 56 of the corresponding opening 54.

Figure 2:
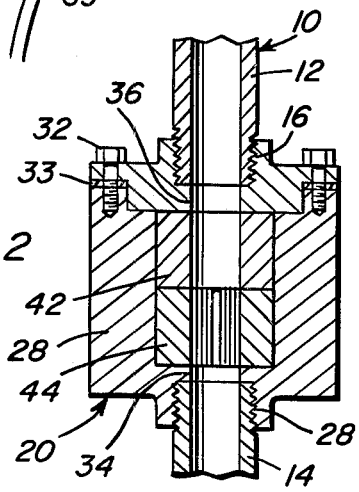
FIG. 2 is an enlarged fragmentary transverse vertical sectional view taken substantially upon the plane indicated by the section line 2—2 of FIG. 1.
Figure 3:
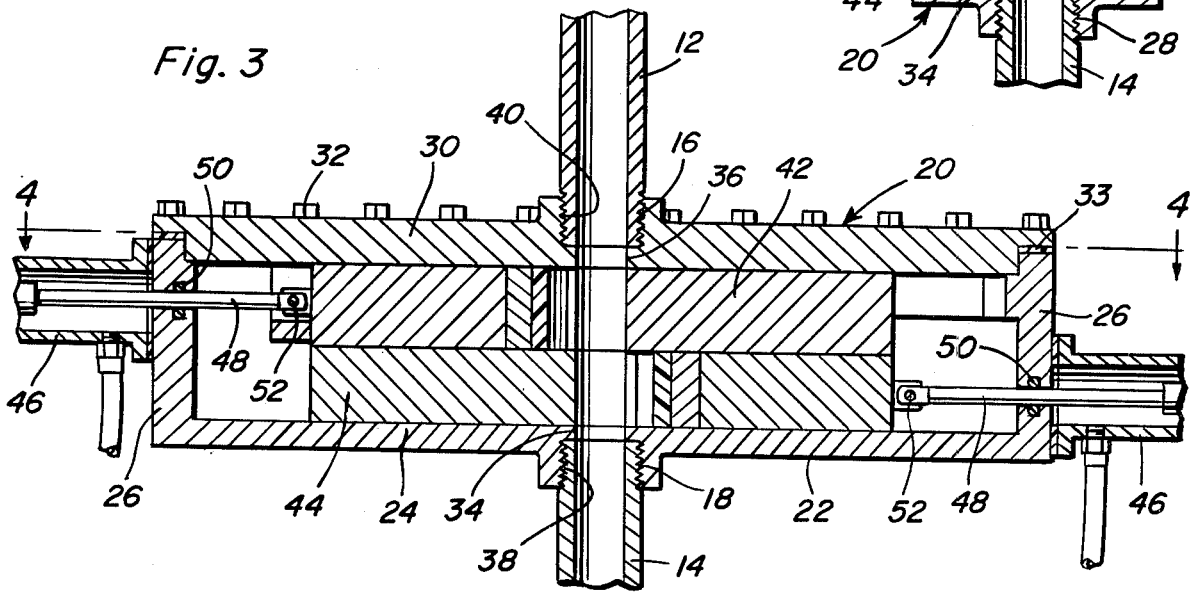
FIG. 3 is an enlarged fragmentary longitudinal vertical sectional view taken substantially upon the plane indicated by the section line 3—3 of FIG. 1.

The housing 22 is interposed in the casing 10 between the sections 12 and 14 thereof in a manner which is believed to be obvious from FIGS. 1, 2 and 3 and the preceding description. The plates 42 and 44 are shiftable within the housing 22 relative to each other and the housing 22 between first positions with the large diameter partial cylindrical ends 56 of the openings 54 registered in a complementary manner to form a larger diameter bore communicating the adjacent ends of the passages 34 and 36, the large diameter bore thus formed being of substantially the same diameter as the adjacent passage ends 34 and 36. The plates 42 and 44 are further shiftable relative to each other and the housing 22 into positions with the small diameter partial cylindrical ends 66 registered with each other and coaxial with the adjacent passage ends 34 and 36. Further, the plates 42 are also shiftable relative to each other within the housing 22 into positions with the openings 54 completely out of registry with each other.

Figure 4:
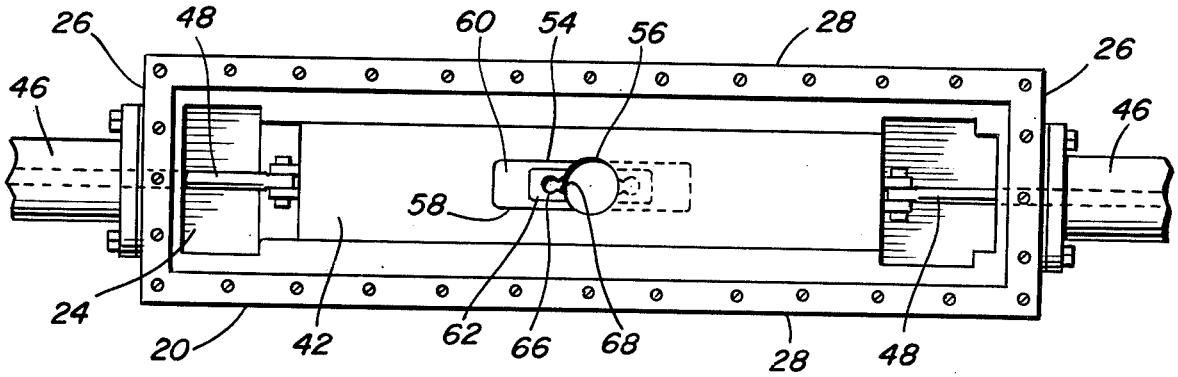
FIG. 4 is a top plan view of the well shutoff device with the upper wall of the housing of the well shutoff device removed.

When the associated well is being drilled and a drill stem extends downwardly through the casing 10, the plates 42 and 44 are positioned as illustrated in FIGS. 3 and 4 of the drawings with the large diameter partial cylindrical ends 56 registered with each other in a complemental manner to form a large diameter bore communicating and extending between the adjacent ends of the passages 34 and 36, the large diameter ends 56 being of substantially the same diameter as the adjacent ends of the passages 34 and 36. In this manner, the drill stem may be rotated and moved up and down through the casing 10 in an unrestricted manner. If a fire develops as a result of effluent from the associated well, the cylinders 46 may then be actuated to displace the corresponding plates 42 and 44 away from the cylinders 46, thereby moving the small diameter end portions 66 into cooperative registry with each other whereby the portions of the inserts 62 defining the small diameter openings 66 will be tightly embraced with the drill stem. Of course, the size of the small diameter partial cylindrical openings 66 defined by the resilient inserts 62 will be selected according to the diameter of the drill string and it is to be noted that when a different size diameter drill string is being used, the inserts 60 will be changed, as required.

If during the operation of the associated well the drill stem is blown out of the well and there is a resultant fire, the escape of effluent from the well feeding the fire may be terminated by shifting the plates 42 and 44 to the third positions thereof with the openings 54 completely out of registry with each other and the passages 34 and 36. In this manner, effluent from the lower casing section 14 may be terminated and the fire will be extinguished enabling well crews to approach the well head and properly secure the well.

The inserts 62, constructed of slightly deformable and resilient material, may be used primarily in conjunction with gas wells, but may also be utilized on oil producing wells.

The hydraulic cylinders 46 have pairs of supply and return lines 69 and 70 operatively connected thereto from a suitable control in communication with a supply of hydraulic fluid under pressure and the control may be located remotely with respect to the associated well.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A well shutoff device including a hollow closed casing having vertically spaced upper and lower walls provided with vertically registered passages formed therethrough relative to which axially spaced lower and upper ends of vertically spaced well casing sections may be sealingly secured, a pair of vertically superposed control plates slidingly mounted within the housing between the upper and lower walls thereof for inverse shifting toward and away from one pair of opposite side walls of the casing between a second pair of opposite casing side walls, each of said plates having a keyhole opening formed therethrough, said openings facing in opposite directions and including large diameter partial cylindrical first ends and small diameter partial cylindrical second ends opening into the first ends, said plates being shiftable relative to each other and said housing between first positions with said second ends of said keyhole openings registered in a complementary manner to form a small diameter bore registered and coaxial with said passages, second positions with said first ends registered in a complementary manner to form a large diameter bore registered with and coaxial with said passages and third positions with said openings completely out of registry with each other and said openings and said passages closed by said control plates, said upper wall of said housing being removably secured to the remainder of said housing, said keyhole opening second ends being defined by replaceable inserts removably received in smaller dimensioned ends of said openings, said inserts each being constructed of slightly deformable and resilient material and defining a restrictive neck passage communicating the corresponding keyhole first and second ends.

2. The combination of claim 1 wherein said housing includes a pair of remotely operable motor means operatively connected between said housing and said plates for selectively shifting said plates relative to each other and said housing from a remote location, said motor means comprising fluid cylinders supported from said housing and including reciprocal piston portions operatively connected to the corresponding control plates.

* * * * *